US008784281B2

(12) United States Patent
Johnson, III

(10) Patent No.: US 8,784,281 B2
(45) Date of Patent: Jul. 22, 2014

(54) WEIGHT LIFTING FREE FALL RESTRAINT SYSTEM

(75) Inventor: Raymond Gene Johnson, III, Berthoud, CO (US)

(73) Assignee: Iron Ally, LLC, Berthoud, CO (US)

( * ) Notice: Subject to any disclaimer, the term of this patent is extended or adjusted under 35 U.S.C. 154(b) by 550 days.

(21) Appl. No.: 13/065,286

(22) Filed: Mar. 18, 2011

(65) Prior Publication Data

US 2011/0230316 A1 Sep. 22, 2011

Related U.S. Application Data

(60) Provisional application No. 61/340,618, filed on Mar. 19, 2010.

(51) Int. Cl.
*A63B 21/078* (2006.01)

(52) U.S. Cl.
USPC ..... 482/104; 482/106

(58) Field of Classification Search
CPC ..... A63B 21/078; A63B 2021/0783; A63B 2021/0786
USPC ..... 482/4, 5, 93, 98, 99, 104, 106
See application file for complete search history.

(56) References Cited

U.S. PATENT DOCUMENTS 4,253,662 A * 3/1981 Podolak ..... 482/104
4,949,959 A * 8/1990 Stevens ..... 482/104
4,998,721 A * 3/1991 Anders et al. ..... 482/4
5,048,826 A * 9/1991 Ryan ..... 482/7
5,108,354 A * 4/1992 Becker ..... 482/104
5,314,394 A * 5/1994 Ronan ..... 482/104
5,407,403 A * 4/1995 Coleman ..... 482/6
5,794,877 A 8/1998 Ono et al.
5,989,164 A * 11/1999 Kullman et al. ..... 482/93
6,623,409 B1 * 9/2003 Abelbeck ..... 482/104
6,926,649 B2 * 8/2005 Slawinski ..... 482/104
7,163,488 B2 * 1/2007 Anders et al. ..... 482/4
2003/0158020 A1 * 8/2003 Johnson ..... 482/112
2004/0092369 A1 * 5/2004 Slawinski et al. ..... 482/104
2009/0203505 A1 * 8/2009 Kroll et al. ..... 482/104
2009/0312162 A1 * 12/2009 Maiaro et al. ..... 482/104

OTHER PUBLICATIONS

U.S. Appl. No. 61/340,618, filed Mar. 19, 2010.

Impex Fitness. On-line catalog, http://wwww.impex-fitness.com/products.asp, originally downloaded Mar. 18, 2011, 2 pages.

* cited by examiner

*Primary Examiner* — Loan H Thanh
*Assistant Examiner* — Sundhara Ganesan
(74) *Attorney, Agent, or Firm* — Craig R. Miles; CR Miles, P.C.

(57) ABSTRACT

Generally, a weight lifting free fall restraint system which includes a support frame providing at least one free fall restraint element which, when coupled to a weight bar, retractably pays out a tether element in response to movement of the weight bar and restrains retractable pay out of the tether element in response to free fall of the weight bar.

19 Claims, 8 Drawing Sheets

WEIGHT LIFTING FREE FALL RESTRAINT SYSTEM

This United States Non-provisional patent application claims the benefit of U.S. Provisional Patent Application No. 61/340,618, filed Mar. 19, 2010, hereby incorporated by reference herein.

I. BACKGROUND

Generally, a weight lifting free fall restraint system which includes a support frame providing at least one free fall restraint element which, when coupled to a weight bar, retractably pays out a tether element in response to movement of the weight bar and restrains retractable pay out of the tether element in response to free fall of the weight bar.

Spotting, in weight or resistance training, is the act of supporting another person during a particular exercise, with an emphasis on allowing the participant to lift or push more than he or she could normally do safely. Correct spotting involves knowing when to intervene and assist with a lift, and encouraging a training partner to push beyond the point in which they would normally 'rack' the weight (return it to its stationary position). Spotting is particularly prevalent, and recommended when performing the bench press. Because of the risks of lifting a heavy weight in the supine position, a lifter will often ask for a spot unless he or she is completely confident that the lift will not fail. However, a spotter may not be available when a weight lifter commences a particular weight lifting exercise. Even in view of the risk, the weight lifter often commences to lift without a spot.

While counterbalanced weight systems are available, weight lifters often prefer to perform free weight lifting exercises because many more muscle (fibers) groups are recruited due to the simultaneous control and stabilization of the weight which is required. It is this stabilization (muscles recruited) aspect that makes free weights superior to counterbalanced weight machines. Unfortunately, there does not appear to be any device available to replace or act as a spotter for the performance of free weight lifting exercises.

The instant invention provides a weight lifting free fall restraint device which operates to replace a spotter for the performance free weight lifting exercises.

II. SUMMARY OF THE INVENTION

Accordingly, a broad object of the invention can be to provide a weight lifting free fall restraint device which includes a free fall restraint element which can be coupled between a support frame and a weight bar which allows normal performance of a weight lifting exercise with the advantage of interrupted movement of the weight bar if the lift fails, or the movement of the weight bar exceeds a predetermined pay out rate of free fall restraint element, thereby protecting the weight lifter from injury.

Another broad object of the invention can be to provide a method of performing a weight lifting exercise in relation to the weight lifting free fall restraint device which provides the advantage of protecting the weight lifter from injury even in the absence of a spotter.

Another broad object the invention can be to provide a kit for a weight lifting free fall restraint device which includes at least one support element capable of being assembled into a support frame, a free fall restraint element capable of being coupled to the support frame in fixed relation to a support surface which provides a tether pay out element which retractably pays out a tether and a tether restraint element which interrupts retractable pay out of said tether upon exceeding a predetermined pay out rate and a securement element coupled to said tether adapted to couple to a weight bar.

Naturally, further objects of the invention may be disclosed throughout other areas of the specification, drawings, photographs, and claims.

III. A BRIEF DESCRIPTION OF THE DRAWINGS

IV. DETAILED DESCRIPTION OF THE PREFERRED EMBODIMENTS

Generally, a weight lifting free fall restraint device which includes a support frame coupled to at least one free fall restraint element which retractably pays out a tether in response to movement of weight bar and interrupts retractable pay out of the tether in response to acceleration associated with free fall of the weight bar or in excess of a predetermined pay out rate.

Figure 1:
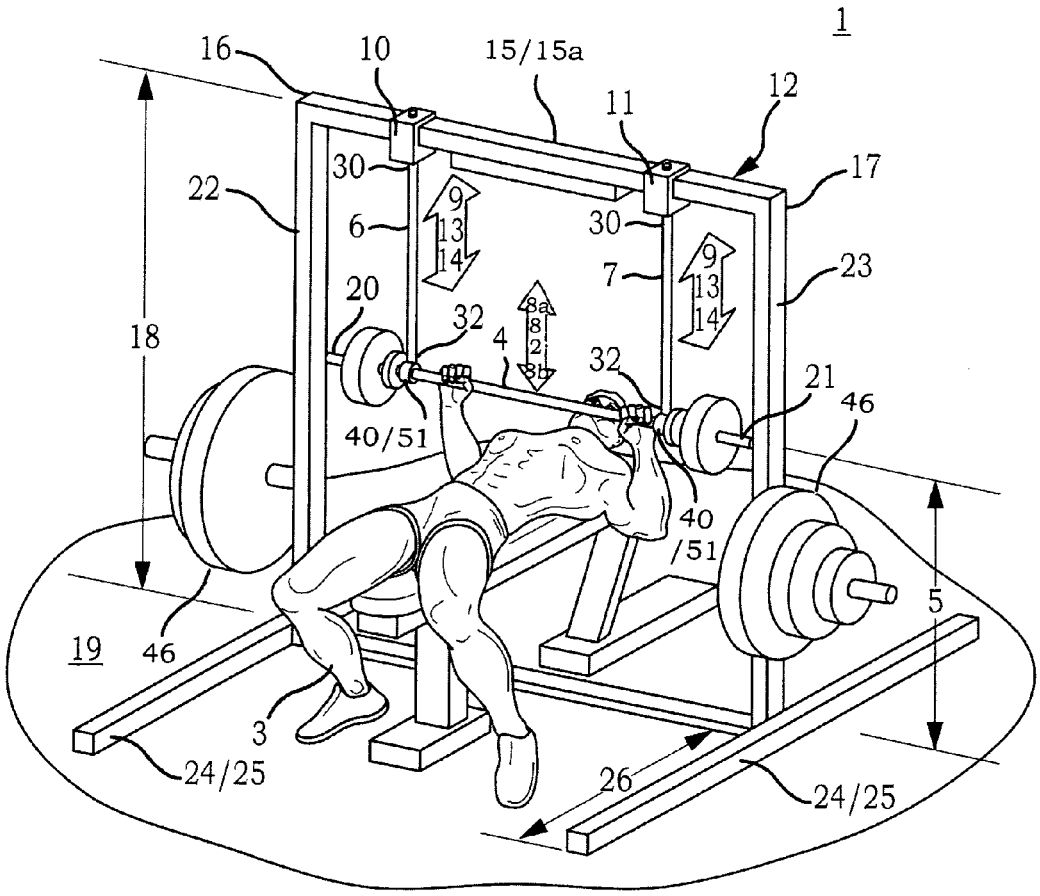
FIG. 1 is a perspective view which shows a method of using a particular embodiment of the invention.

Now referring primarily to FIG. 1, an illustrative non-limiting example of a method of using the inventive weight lifting free fall restraint device (1) (also referred to as the "device") in performance of a weight lifting exercise (2) is shown. While the illustrative example shows a bench press being performed by a weight lifter (3), the invention is not so limited, and particular embodiments of the device (1) can be used in performance of a numerous and wide variety of weight lifting exercises (2) such as bar bell squat, military press, skull crushers, dumbbell press, flies, incline press, shoulder press, seated dumbbell press, side lateral raises, dumbbell curls, hammer curls, preacher curls, lying barbell extensions, triceps dumbbell extensions, or the like.

As to a particular embodiment of the method, a weight lifter (3) can obtain a weight bar (4). While there is no standard weight or length for a weight bar (4), barbells are typically between about four feet and about seven feet with a central portion that may vary in diameter, but can be about one inch. The weight bar (4) as dumbbells, are typically between 12 inches and 24 inches in length with a central portion that may vary in diameter, but can be about one inch. Weight bars (4) suitable for use with the invention are available from numerous and wide variety of sources such as Impex Inc., 14777 Don Julian Road, City of Industry, Calif. 91746. One or more weights (46) are typically added or removed from each end of the weight bar (4). The weights (46) typically take the form of disc weights or weight plates which slide onto the outer portions of the weight bar (4). Weights (46) suitable for use with the invention can be obtained from a numerous and wide variety of sources such as Impex Inc., 14777 Don Julian Road, City of Industry, Calif. 91746.

The weight bar (4) can be removeably coupled to a securement element (40) proximate the second end (32) of one or more tether(s) (6)(7) which retractably pay out from a corresponding one or more tether pay out elements (28) (as to particular embodiments a "tether spool") of a corresponding one or more free fall restraint elements (10)(11) coupled to a support frame (12) depending upon the weight lifting exercise (2). The weight lifter (3) can adjust the height (18) of the support frame (12) to locate the weight bar (4) at a location which can be gripped to perform at least one weight lifting exercise (2).

A weight lifter (3) positioned to perform the weight lifting exercise (2) grips the weight bar (4) suspended at the height (5) by the one or more tethers (6). The weight lifting exercise (2) using the device (1) can be performed by movement (8) of the weight bar (4) in a first direction (8*a*) which allows the one or more tether pay out elements (28) to retract paid out tether (6)(7). The weight bar (4) can be moved (8) in a second direction (8*b*) which allows the one or more tether pay out elements (28) to pay out the tether (6)(7). A tether restraint element (33) (see for example FIG. 9) of the free fall restraint element(s) (10)(11) can each restrain or interrupt pay out (9) of a corresponding one of the tethers (6)(7) to fix the weight bar (4) at a weight bar height (5) above the weight lifter (3) in the event of an increase in a tether pay out rate (13) in excess of a predetermined tether pay out rate (14) or free fall of the weight bar (4).

Now referring primarily to FIGS. 1, 7, 8, and 9, the predetermined tether pay out rate (14) at which the tether restraint element (28) interrupts retractable pay out (9) of the tether (6)(7) can be selected by the weight lifter (3) by operation of a predetermined pay out rate adjustment element (43) coupled to the tether restraint element (10)(11). The predetermined pay out rate (14) can be selected from a range (42) of predetermined pay out rates (14). At one end of the range (42) of predetermined pay out rates (14), the weight bar (4) can free fall under gravity unrestrained or uninterrupted by the tether restraint element (33) and at the other end of the range (42) any pay out of the tether (6) by movement of the weight bar (4) can be restrained or interrupted by the tether restraint element (33). Incremental increase or decrease of the predetermined pay out rate (14) can be selected within the range (42). The weight lifter (3) can add one or more weights (46) to the weight bar (4) in performance of the weight lifting exercise (2) with the device (1).

Now referring primarily to FIGS. 2-6, a particular embodiment of the weight lifting free fall restraint system (1) includes a support frame (12). The support frame (12) can have a configuration to which at least one free fall restraint element (10)(11) can be coupled to retractably pay out (9) a tether element (6) which can be coupled to a weight bar (4). The non-limiting embodiment of the support frame (12) shown in the Figures provides a horizontal member (15) disposed in generally horizontal relation to the support surface (19) having a length disposed between a first end (16) and a second end (17). The length of the horizontal member (15) can be sufficient to fixedly receive or couple one or more free fall restraint elements (10)(11). As to those embodiments which utilize more than one free fall restraint elements (10(11), the free fall restraint elements (10)(11) can be disposed a sufficient distance apart to correspondingly retractably pay out (9) the corresponding tether elements (6)(7) proximate the opposed ends (20)(21) of a weight bar (4). As to certain embodiments of the horizontal member (15), the length can be sufficient to allow the distance between the free fall restraint elements (10) to be adjusted depending upon the length of the weight bar (4), or allow each free fall restraint element (10) to be used independent of the other free fall restraint elements (10) coupled to the horizontal member (15). While the horizontal member (15) shown in the Figures provides a tubular extrusion generally square in cross section, the invention is not so limited and the horizontal member (15) can be circular, rectangular, oval, triangular, T shaped, or U shaped in cross section, or of any other cross sectional configuration, whether solid or tubular, to which at least one free fall restraint element (10)(11) can be coupled to retractably pay (9) out a tether element (6)(7) adapted to couple to a weight bar (4).

Figure 2:
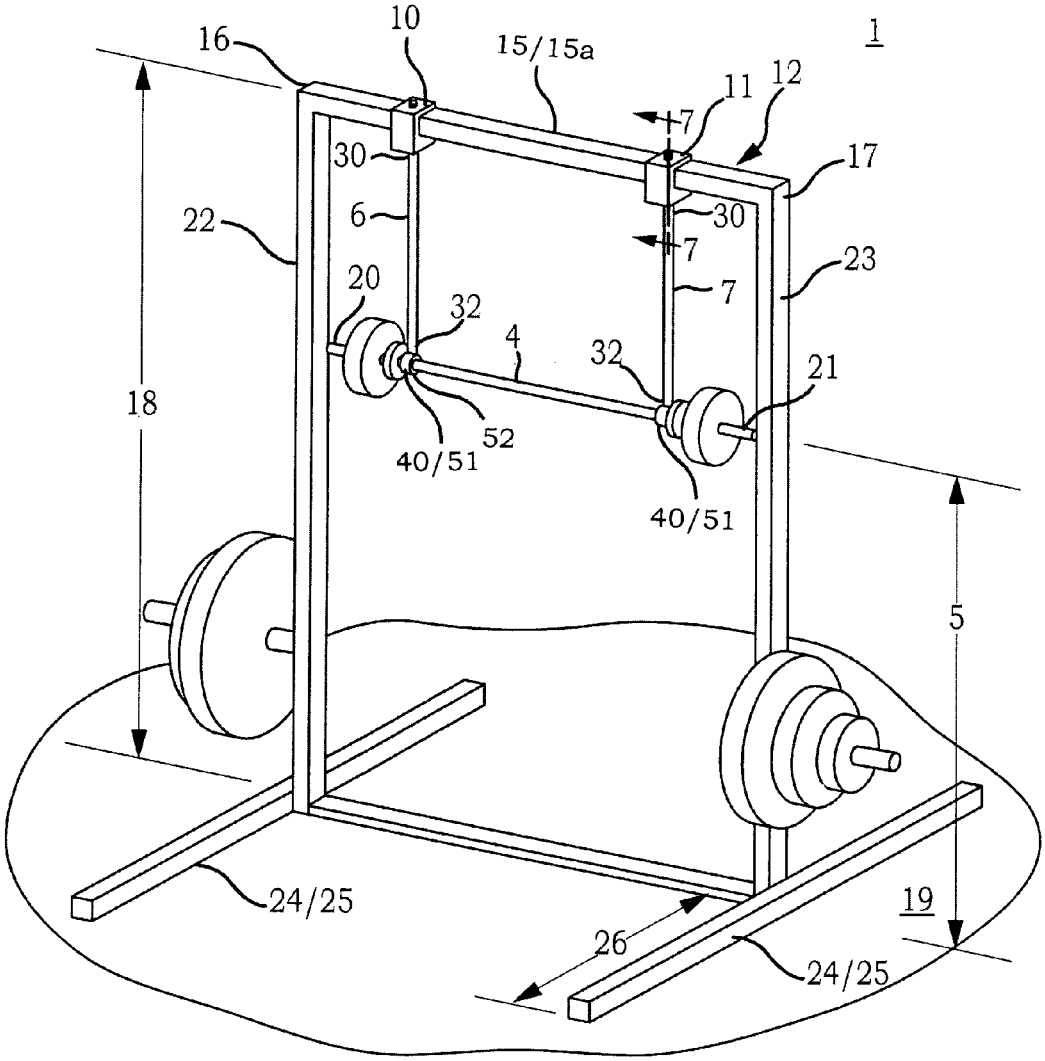
FIG. 2 is a perspective view of a particular embodiment of the invention.
Figure 3:
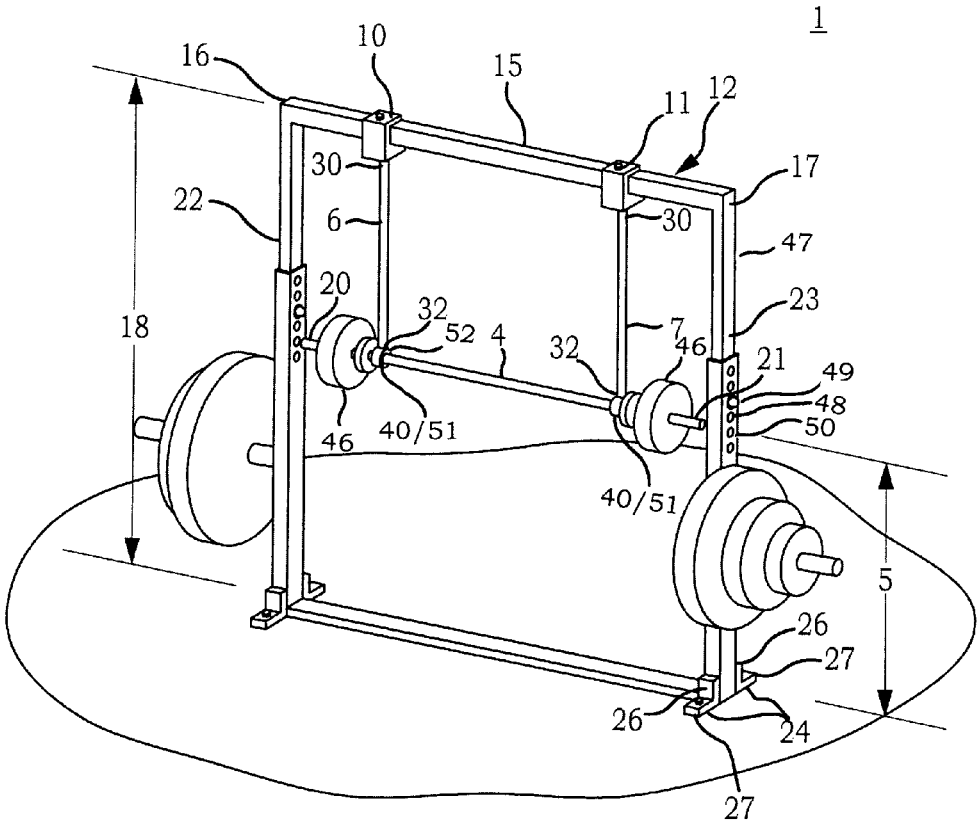
FIG. 3 is a perspective view of a particular embodiment of the invention.
Figure 4:
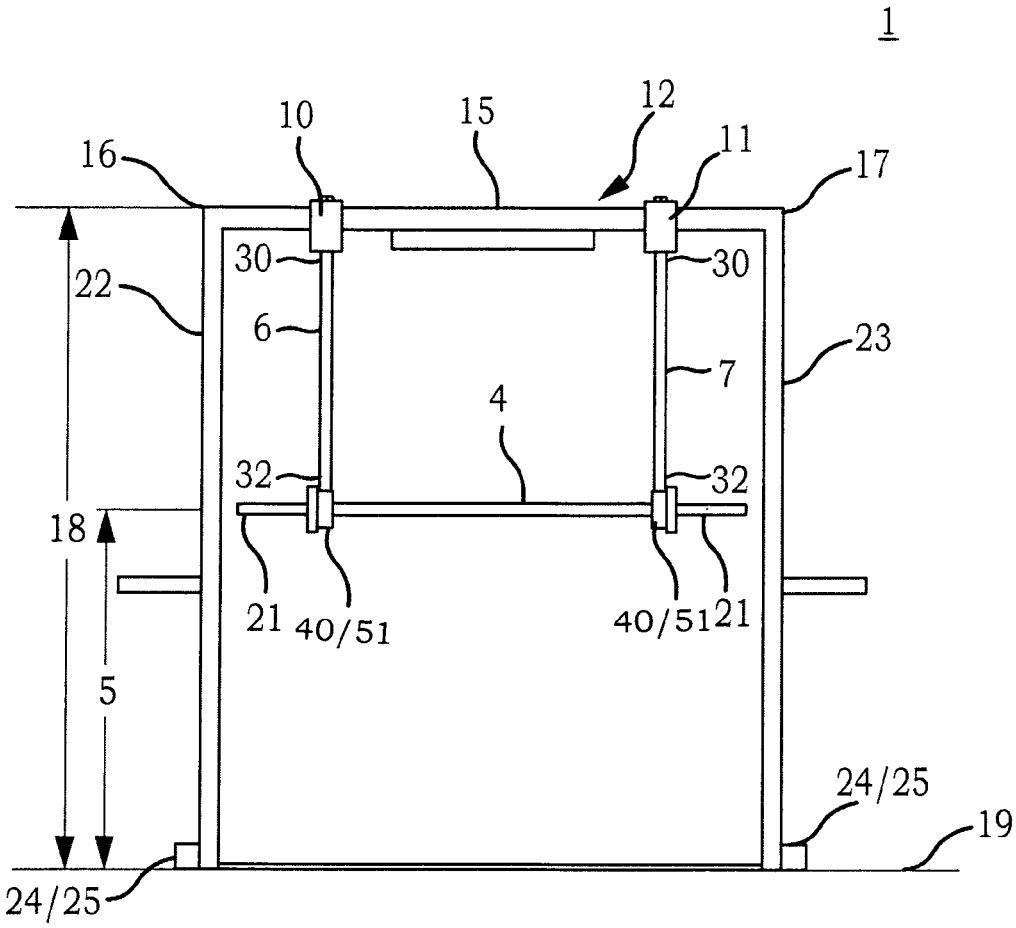
FIG. 4 is a front view of a particular embodiment of the invention.
Figure 5:
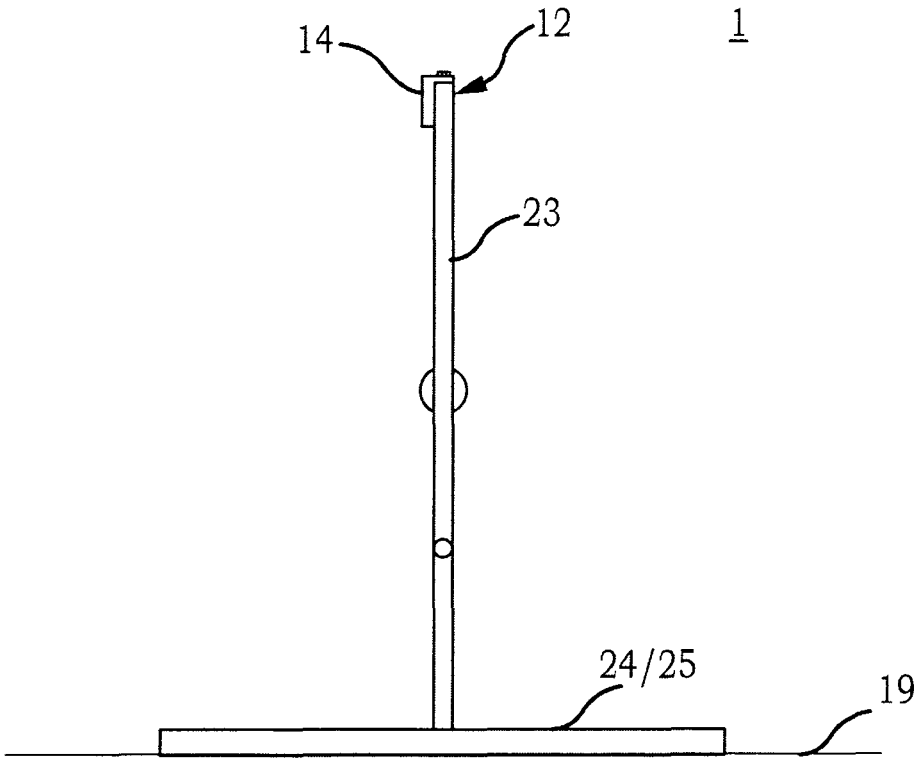
FIG. 5 is a side view of a particular embodiment of the invention.
Figure 6:
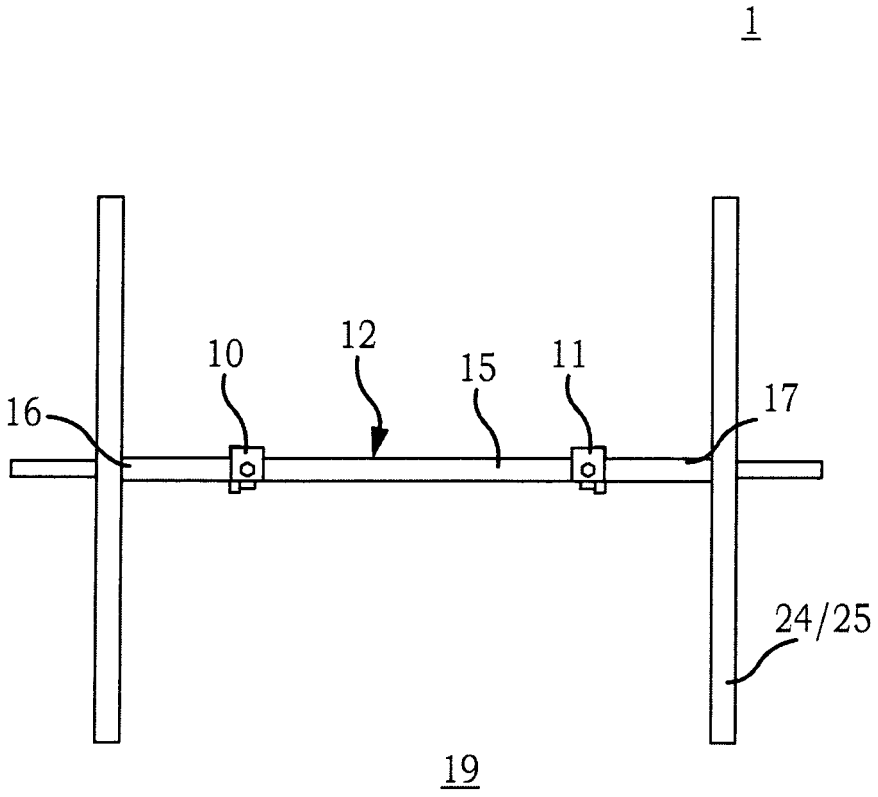
FIG. 6 is a top view of a particular embodiment of the invention.

The horizontal member (15) (or other constructional form of support) can be established at a height (18) above the support surface (19). The particular embodiment of the invention shown in FIGS. 1-6 establishes the horizontal member (15) at a particular fixed height (18) by coupling the first end (16) and the second end (17) to a corresponding first vertical support member (22) and a second vertical support member (23) of fixed length. Alternately, as shown in the example of FIG. 3, the vertical support members (22)(23) can be adjusted in length (or be variably adjustable in length) to establish the horizontal member (15) within a range of heights (18) depending upon the a particular weight lifting exercise (2). For conventional weight lifting exercises (2), the range of height can be between about 24 inches and about 120 inches. The particular embodiment of the pair of vertical support members (22)(23) shown in FIG. 3, provide an inner vertical support (47) slidably coaxially disposed within an outer vertical support (48) which allows length of each of the pair of vertical supports (22)(23) to be adjusted in fixed relation by operation of a vertical support adjustment element (49). While the vertical support adjustment element (49) shown in FIG. 3 comprises a bullet catch coupled to the inner vertical support (47) retractably extendable in relation to a vertical series of aperture elements (50) in the outer vertical support (48) to maintain the inner vertical support (47) in adjustable fixed relation with the outer vertical support (48); the invention is not so limited.

Each vertical support member (22)(23) can be established in generally vertical relation to the support surface (19) by providing one or more support surface mounts (24) configured to couple to a corresponding one or more vertical support members (22)(23) and sufficiently engage the support surface (19) to fix the corresponding vertical support members (22)(23) in generally vertical relation to the support surface (19). One particular embodiment of the support surface mounts (24) as shown in FIG. 2 couples an elongate member (25) in generally perpendicular relation to each vertical support member (22)(23). The elongate member(s) (25) extend(s) a sufficient distance (26) outwardly from the vertical member to sufficiently fix the location of the elongate member (25) in generally vertical relation to the support surface (19) for performance of a particular weight lifting exercise (2). Another particular embodiment of the support surface mounts (24), as shown in FIG. 3, can have a configuration which provides a first portion (26) which connects to the vertical support member (22) and a second portion (27) fixedly attached to the support surface (19).

While these non-limiting examples of a support frame (12) can be utilized to locate one or more of the free fall restraint elements (10)(11) in accordance with the invention; the support frame (12) can take the constructional form of suspension cables, cross members attached to the ceiling of a building, cross members supported between partitions in a building, or the like, which places one or more tether elements (6)(7) in relation to the weight bar (4) used in a particular weight lifting exercise (2).

Figure 7:
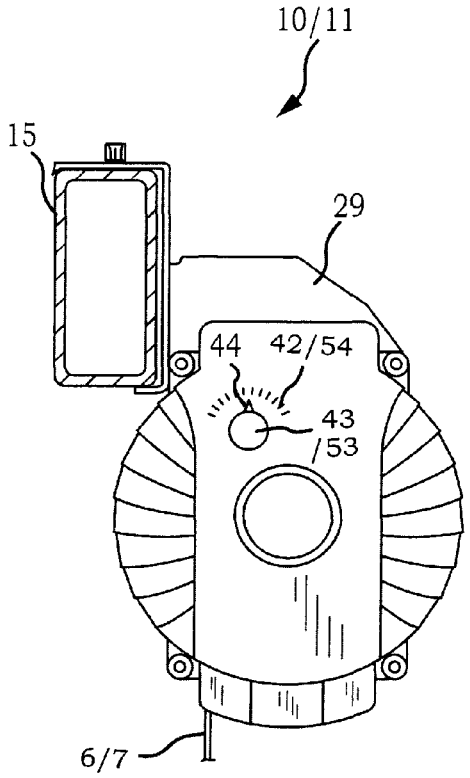
FIG. 7 is a side view of a particular embodiment of a free fall restraint element having a predetermined pay out rate adjustment element.
Figure 8:
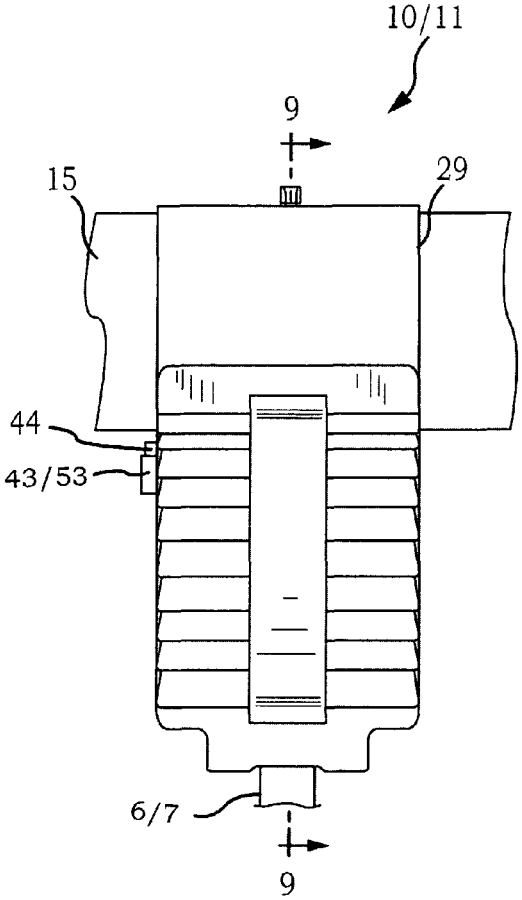
FIG. 8 is a front view of the particular embodiment of a free fall restraint element shown in FIG. 7.
Figure 9:
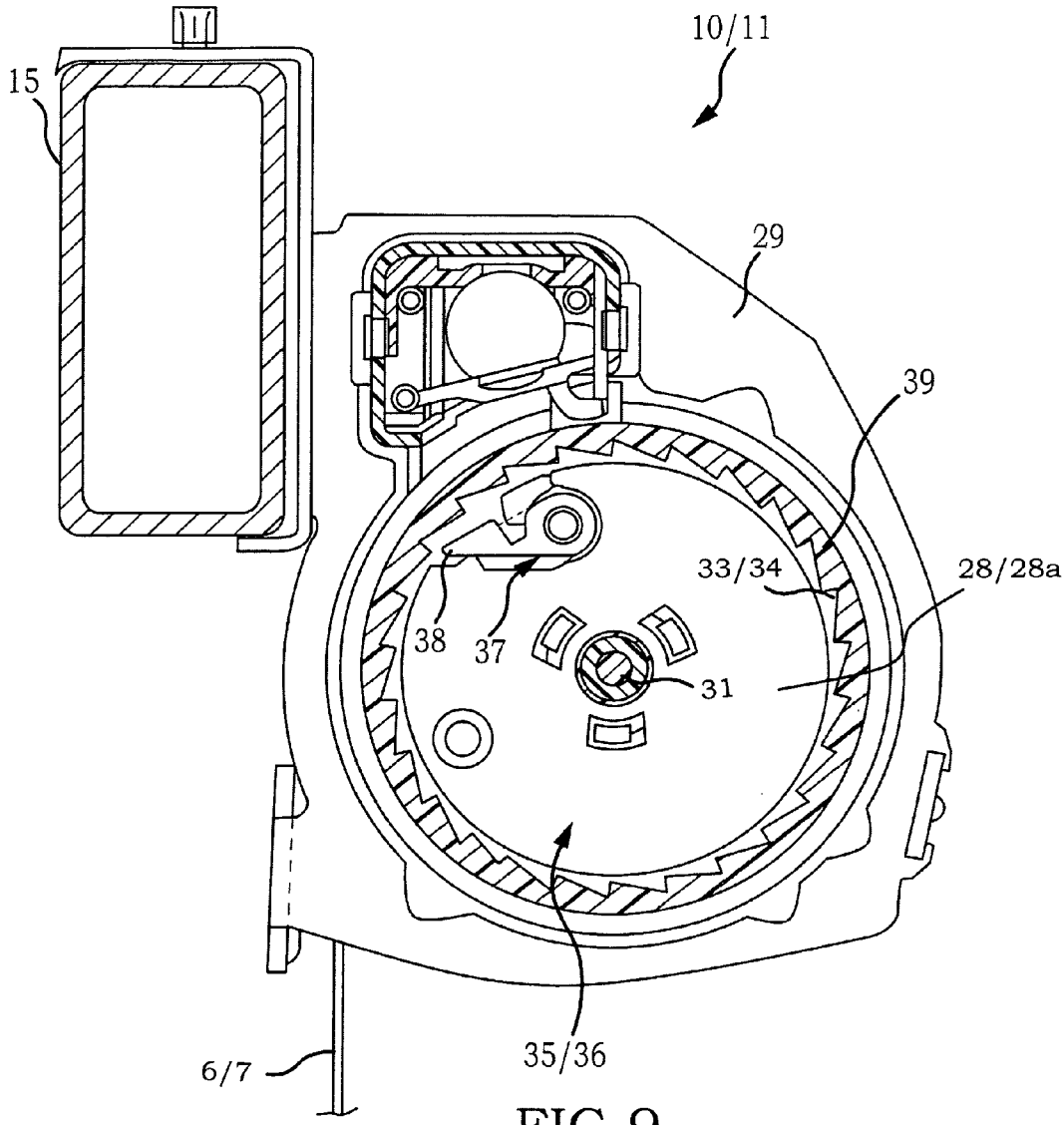
FIG. 9 is a cross section view 9-9 of a particular embodiment of a free fall restraint element having a tether pay out element which retractably pays out a tether and a tether restraint element which interrupts retractable pay out of said tether upon exceeding a selected predetermined pay out rate.

Now referring primarily to FIGS. 7-9, embodiments of the invention can provide at least one free fall restraint element (10)(11). The at least one free fall restraint element (10)(11) can be coupled to an embodiment of the support frame (12), as above described. The free fall restraint element (10)(11) can provide a tether pay out element (28) which retractably pays out a tether (6)(7). While the embodiment of the free fall restraint element (10)(11) shown in FIG. 9 provides the tether pay out element (28) in the form of a tether spool (28) which rotatably secures in a restraint housing (29); the invention is not so limited. A tether element (6) can have a first end (30) secured to the spool (28*a*). Upon rotation of the spool (28*a*) within the restraint housing (29) in the tether (6)(7) retractably pays out (9) from the restraint housing (29). The rotation of the spool (28*a*) resulting from retractably paying out the tether element (6)(7) can load a spring element (31) which can unload to rotate the spool (28) in the opposite direction to retract the tether element (6)(7) which can be wound upon itself about the tether spool (28*a*).

The second end (32) of each tether (6)(7) can be secured to a weight bar (4). The securement element (40) can take the form of an annular member (51) having an annulus (52) adapted to receive within a portion of a weight bar (4) and suspend the weight bar (4) by the tether (6)(7) at a weight bar height (5) in relation to a support surface (19). The weight bar height (5) above the support surface (19) can allow a weight lifter (3) to grip the weight bar (4) to perform at least one weight lifting exercise (2). The annular member (51) can take the form of a ring as shown for example in FIGS. 2 and 3. As an alternate embodiment, the annular member (51) can take the form of a terminal loop formed in the tether element (6)(7), or the like. During performance of a weight lifting exercise (2) the tether element (6)(7) can retractably pay out (9) from the free fall restraint element (10)(11) in accordance with movement (8) of the weight bar (4). While the particular embodiment of the tether element (6)(7) shown by the Figures has the constructional form of a strap, the invention is not so limited, and any constructional form such as a cable, cord, flexible bands or belts (whether of metal, plastic or woven material), or the like that can be wound on a spool or other retractable means can be utilized.

The free fall restraint element (10)(11) can further include a tether restraint element (33) (also referred to as an acceleration limiter) which operates to interrupt or limit retractable pay out (9) of the tether element (6)(7) from the spool (28*a*) when retractable pay out (9) from the spool (28*a*) exceeds a predetermined pay out rate (14). In certain non-limiting embodiments of the invention, the tether restraint element (33) can take the form of a toothed ratchet ring (34) located axially adjacent one or both rims (35)(36) (or ends) of the spool (28*a*). A pawl (37) can be made responsive to the rotation of a rim (35)(36) (or the end of the spool) such that a contact surface (38) of the pawl (37) configured to engage the teeth (39) of the toothed ratchet ring (34) travels toward and away from the toothed ratchet ring (34) in relation to increase and decrease of the tether pay out rate (13) of the tether element (6)(7). At a predetermined tether pay out rate (14) the contact surface (38) of the pawl (37) engages the teeth (39) of the tooth ratchet ring (34) interrupting retractable pay out (9) of the tether element (6)(7) from the spool (28*a*). Travel of the weight bar (4) secured to the second end (32) of the tether element (6)(7) can be correspondingly interrupted. As one non-limiting example, if during performance of a weight lifting exercise (2) with a weight bar (4) secured to the second end (32) of the tether element (6)(7), the weight bar (4) free falls under gravity (for example the weight bar is dropped), the pay out rate (13) of the tether element (6)(7) increases and moves the contact surface (38) of the pawl (37) to engage the teeth (39) of the toothed ratchet ring (34) at the predetermined pay out rate (14) interrupting retractable pay out (9) of the tether element (6)(7) from the spool (28*a*) and arresting free fall of the weight bar (4).

Embodiments of the tether restraint element (33) can further include a predetermined pay out rate adjustment element (43) which allows selection of the predetermined pay out rate (14) at which the tether restraint element (14) interrupts retractable pay out of the tether (6)(7). The predetermined pay out rate (14) can be selected from a range (42) of predetermined pay out rates (14), as above described. Now referring primarily to FIG. 7, embodiments of the predetermined pay out rate adjustment element (43) can include a pay out rate selector (53) which provides an indicator (44) incrementally rotatably alignable to pay out rate indicia (54) within the range (42) of predetermined pay out rates (14). Adjustment of the pay out rate selector (53) acts to increase or decrease resistance to travel of the pawl (37). At one end of the range (42) of predetermined pay out rates (14), resistance sufficient to prevent the pawl (37) from travel and engagement with the teeth (39) of the toothed ring (34) allows the weight bar (4) to free fall under gravity unrestrained or uninterrupted by the tether restraint element (33) and at the other end of the range (42) resistance insufficient to impede travel of the pawl (37) to engage the teeth (39) of the toothed ring (34) interrupts pay out of the tether (6)(7) in response to any movement of the weight bar (4). Incremental increase or decrease of the predetermined pay out rate (14) can be selected within the range (42) as appropriate to the weight lifting exercise (2). The weight lifter (3) can add one or more weight (46) to the weight bar (4) in performance of the weight lifting exercise (2) with the device (1). While a particular example of free fall restraint element (10)(11) is provided, the invention is not limited to this particular configuration to interrupt travel of the weight bar (4) in the event that retractable pay out (9) exceeds the predetermined pay out rate (14). For example, a locking retractor or similar locking retractor to that shown in U.S. Pat. No. 5,794,877, hereby incorporated by reference herein, can be adapted for use with the invention.

Again referring primarily to FIGS. 1-8, embodiments of the invention can take the form of a kit for assembling a weight lifting free fall restraint device (1) which includes one or more free fall restraint elements (10)(11) as above described adapted for coupling to a support frame (12), as above described, in fixed relation to a support surface (19). The free fall restraint elements (10)(11) including the tether pay out element (28) which retractably pays out a tether (6)(7) and a tether restraint element (33) which interrupts retractable pay out of the tether (6)(7) upon exceeding a predetermined pay out rate (14), as above described, and a securement element (40) adapted to couple or receive a weight bar (4) coupled or which can be assembled to the tether (6)(7). The kit can further include at least one support element (15) or a plurality of support elements (15)(22)(23)) capable of being assembled into a support frame (12). Embodiments of at least one support element (15) can provide an elongate member (15*a*) capable of being established in horizontal relation to a support surface (19). The kit can further include a pair of vertical support members (22)(23) which are capable of being coupled to a first end (16) and a second end (17) of said elongate member (15*a*). Each of the pair of vertical supports (22)(23) can be provided as an inner vertical support (47) and an outer vertical support (48) disposed in or which can be slidably coaxially assembled which allows length of each of the pair of vertical supports (22) (23) to be adjusted by operation of a vertical support adjustment element (49) to maintain the inner vertical support (47) in fixed relation with the outer vertical support (48), as above described.

As can be easily understood from the foregoing, the basic concepts of the present invention may be embodied in a variety of ways. The invention involves numerous and varied embodiments of a weight lifting free fall restraint system (1).

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of "a lift" should be understood to encompass disclosure of the act of "lifting"—whether explicitly discussed or not—and, conversely, were there effectively disclosure of the act of "lifting", such a disclosure should be understood to encompass disclosure of "lift" and even a "means for lifting." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

For the purposes of the present invention, ranges may be expressed herein as from "about" one particular value to "about" another particular value. When such a range is expressed, another embodiment includes from the one particular value to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. In the absence of any express written value, "about" means within +/−10 percent of the numerical value indicated.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the weight lifting free fall restraint systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A weight lifting free fall restraint device, comprising:

a) a support frame;

b) at least one free fall restraint element fixedly coupled to said support frame, said free fall restraint element including:

i) a tether pay out element which retractably pays out a tether, said tether pay out element including:

a spool rotatably secured in a restraint housing;

a spring element coupled to said spool, wherein rotation of said spool in a first direction loads said spring element, said spring element unloads to rotate said spool in the opposite second direction, said tether having a tether first end coupled to said spool, whereby, upon rotation of said spoon in said first direction said tether retractably pays out from said restraint housing and upon rotation of said spool in said second direction said tether winds upon said spool to retract said tether into said restraint housing;

ii) a tether restraint element which interrupts retractable pay out of said tether upon exceeding a predetermined pay out rate, said tether restraint element including:

a toothed ratchet ring located axially adjacent a rim of said spool;

a pawl pivotally coupled to said rim of said spool, said pawl travels in response to rotation of said spool to engage said toothed ratchet ring at said predetermined tether pay out rate to interrupt retractable pay out of said tether from said spool; and iii) a predetermined pay out rate adjustment element which allows selection of said predetermined pay out rate at which said tether restraint element interrupts retractable pay out of said tether, said pay out rate adjustment element including a pay out rate selector adjustable to increase or decrease resistance to travel of said pawl in response to rotation of said spool; and c) a securement element coupled to said tether, said securement element adapted to couple to a weight bar to suspend said weight bar by said tether at a height in relation to a support surface.

2. The weight lifting free fall restraint device of claim 1, wherein said support frame coupled to said at least one free fall restraint element has a configuration adapted to dispose said weight bar coupled to said securement element at said height in relation to said support surface which allows a lifter to grip said weight bar to perform at least one weight lifting exercise.

3. The weight lifting free fall restraint device of claim 1, wherein said securement element coupled to said tether comprises an annular member which provides an annulus configured to receive within the end of said weight bar.

4. The weight lifting free fall restraint device of claim 1, wherein said securement element coupled to said tether comprises a terminal loop in said tether, said terminal loop configured to receive within the end of said weight bar.

5. A method of using a weight lifting free fall restraint device, comprising the steps of:

a) coupling a weight bar to at least one securement element correspondingly coupled to a free fall restraint element fixedly coupled to a support frame, said free fall restraint element including:

i) a tether pay out element, said tether pay out element including:

a spool rotatably secured in a restraint housing;

a spring element coupled to said spool, wherein rotation of said spool in a first direction loads said spring element, said spring element unloads to rotate said spool in the opposite second direction, said tether having a tether first end coupled to said spool, whereby, upon rotation of said spool in said first direction said tether retractably pays out from said restraint housing and upon rotation of said spool in said second direction said tether winds upon said spool to retract said tether into said restraint housing; and ii) a tether restraint element which interrupts retractable pay out of said tether upon exceeding a predetermined pay out rate, said tether restraint element, including:

a toothed ratchet ring located axially adjacent a rim of said spool;

a pawl pivotally coupled to said rim of said spool, said pawl travels in response to rotation of said spool to engage said toothed ratchet ring at said predetermined tether pay out rate to interrupt retractable pay out of said tether from said spool;

iii) a predetermined pay out rate adjustment element which allows selection of said predetermined pay out rate at which said tether restraint element interrupts retractable pay out of said tether, said pay out rate adjustment element including a pay out rate selector adjustable to increase or decrease resistance to travel of said pawl in response to rotation of said spool.

6. The method of using the weight lifting free fall restraint device of claim 5, further comprising the step of moving said weight bar in a first direction which allows said free fall restraint element to retract paid out tether.

7. The method of using the weight lifting free fall restraint device of claim 6, further comprising the step of moving said weight bar in a second direction which allows said free fall restraint element to retractably pay out said tether from said free fall restraint element.

8. The method of using the weight lifting free fall restraint device of claim 7, further comprising moving said weight bar in said second direction which exceeds said predetermined pay out rate to interrupt retractable pay out of said tether to fix location of said weight bar.

9. The method of using the weight lifting free fall restraint device of claim 8, further comprising the step of selecting a predetermined pay out rate at which said tether restraint element interrupts retractable pay out of said tether by operation of a predetermined pay out rate adjustment element coupled to said tether pay out element.

10. A method of producing a weight lifting free fall restraint device, comprising the steps of:

a) providing a support frame;

b) coupling at least one free fall restraint element to said support frame, said free fall restraint element including:

i) a tether pay out element which retractably pays out a tether, said tether pay out element including:

a spool rotatably secured in a restraint housing;

a spring element coupled to said spool, wherein rotation of said spool in a first direction loads said spring element, said spring element unloads to rotate said spool in the opposite second direction, said tether having a tether first end coupled to said spool, whereby, upon rotation of said spool in said first direction said tether retractably pays out from said restraint housing and upon rotation of said spool in said second direction said tether winds upon said spool to retract said tether into said restraint housing;

ii) a tether restraint element which interrupts retractable pay out of said tether upon exceeding a predetermined pay out rate, said tether restraint element including:

a toothed ratchet ring located axially adjacent a rim of said spool;

a pawl pivotally coupled to said rim of said spool, said pawl travels in response to rotation of said spool to engage said toothed ratchet ring at said predetermined tether pay out rate to interrupt retractable pay out of said tether from said spool; and iii) a predetermined pay out rate adjustment element which allows selection of said predetermined pay out rate at which said tether restraint element interrupts retractable pay out of said tether, said pay out rate adjustment element including a pay out rate selector adjustable to increase or decrease resistance to travel of said pawl in response to rotation of said spool; and c) coupling a securement element to said tether, said securement element adapted to couple to a weight bar to suspend said weight bar by said tether at a height in relation to a support surface.

11. The method of producing a weight lifting free fall restraint device of claim 10, wherein said step of providing a support frame further comprises the step of configuring said support frame coupled to said at least one free fall restraint element to dispose said weight bar coupled to said securement element at said height in relation to said support surface which allows a lifter to grip said weight bar to perform at least one weight lifting exercise.

12. The method of producing a weight lifting free fall restraint device of claim 10, wherein said step of coupling a securement element to said tether adapted to couple to a weight bar comprises the step of coupling an annular member to said tether having an annulus of sufficient dimension to receive an end of said weight bar.

13. The method of producing a weight lifting free fall restraint device of claim 10, wherein said step of coupling a securement element to said tether adapted to couple to a weight bar comprises the step of providing a terminal loop in said tether, said terminal loop configured to receive within the end of said weight bar.

14. A kit for a weight lifting free fall restraint device, comprising:

a) a support frame;

b) at least one free fall restraint element which couples to said support frame, said free fall restraint element including:

i) a tether pay out element which retractably pays out a tether, said tether pay out element including:

a spool rotatably secured in a restraint housing;

a spring element coupled to said spool, wherein rotation of said spool in a first direction loads said spring element, said spring element unloads to rotate said spool in the opposite second direction, said tether having a tether first end coupled to said spool, whereby, upon rotation of said spool in said first direction said tether retractably pays out from said restraint housing and upon rotation of said spool in said second direction said tether winds upon said spool to retract said tether into said restraint housing;

ii) a tether restraint element which interrupts retractable pay out of said tether upon exceeding a predetermined pay out rate, said tether restraint element including:

a toothed ratchet ring located axially adjacent a rim of said spool;

a pawl pivotally coupled to said rim of said spool, said pawl travels in response to rotation of said spool to engage said toothed ratchet ring at said predetermined tether pay out rate to interrupt retractable pay out of said tether from said spool; and iii) a predetermined pay out rate adjustment element which allows selection of said predetermined pay out rate at which said tether restraint element interrupts retractable pay out of said tether, said pay out rate adjustment element including a pay out rate selector adjustable to increase or decrease resistance to travel of said pawl in response to rotation of said spool; and c) a securement element coupled to said tether, said securement element adapted to couple to a weight bar.

15. The kit for a weight lifting free fall restraint device of claim 14, wherein said securement element comprises an annular member which provides an annulus of sufficient dimension to allow passage of an end of a weight bar.

16. The kit for a weight lifting free fall restraint device of claim 14, wherein said securement element coupled to said tether comprises a terminal loop in said tether, said terminal loop configured to receive within the end of said weight bar.

17. The kit for a weight lifting free fall restraint device of claim 14, further comprising at least one support element capable of being assembled into a support frame.

18. The kit for a weight lifting free fall restraint device of claim 17, wherein said at least one support element comprises an elongate member capable of being established in horizontal relation to a support surface.

19. The kit for a weight lifting free fall restraint device of claim 18, wherein said at least one support element further comprises a pair of vertical support members which are capable of being coupled to a first end and a second end of said elongate member.

* * * * *